United States Patent [19]

Fisher et al.

[11] 4,359,091

[45] Nov. 16, 1982

[54] RECOVERY OF UNDERGROUND HYDROCARBONS

[76] Inventors: Charles B. Fisher, 2850 Hill Park Rd., Montreal, Quebec H3H 1T1; Sidney T. Fisher, 53 Morrison Ave., Montreal, Quebec H3R 1K3, both of Canada

[21] Appl. No.: 295,558

[22] Filed: Aug. 24, 1981

[51] Int. Cl.[3] ..... E21B 43/24

[52] U.S. Cl. ..... 166/248; 166/266

[58] Field of Search ..... 166/248, 266, 267, 256, 166/250, 251, 65 R, 60, 50, 302; 219/10.75, 10.79

[56] References Cited

U.S. PATENT DOCUMENTS

| | | | |
|---|---|---|---|
| 2,801,090 | 7/1957 | Hoyer et al. | 166/248 X |
| 3,434,541 | 3/1969 | Cook et al. | 166/256 |
| 3,605,888 | 9/1971 | Crowson et al. | 166/248 |
| 3,972,372 | 8/1976 | Fisher et al. | 166/248 |
| 3,988,036 | 10/1976 | Fisher et al. | 299/5 |
| 3,989,107 | 11/1976 | Fisher et al. | 166/248 |
| 4,008,761 | 2/1977 | Fisher et al. | 166/248 |
| 4,008,762 | 2/1977 | Fisher et al. | 166/248 |
| 4,043,393 | 8/1977 | Fisher et al. | 166/248 |
| 4,116,273 | 9/1978 | Fisher et al. | 166/248 |
| 4,140,179 | 2/1979 | Kasevich et al. | 166/248 |

OTHER PUBLICATIONS

Agroskin; A., *Chemistry and Technology of Coal*, Jerusalem 1966, Israel Program for Scientific Translations, p. 59.

Encyclopedia Britannica, Chicago 1960, vol. 21, pp. 363, 364.

Fisher; Sydney T., "Advances in Induction Heating", *Oil and Gas Journal*, Jun. 16, 1980, pp. 82–85.

*Standard Handbook for Mechanical Engineers*, Seventh Edition, McGraw-Hill, Table 26, pp. 4–31.

*Primary Examiner*—Stephen J. Novosad

[57] ABSTRACT

The method of extracting hydrocarbons from an underground deposit of material containing hydrocarbons, which comprises injecting aqueous solutions of low resistivity into at least a portion of the deposit, heating a portion of the deposit underground by means of a varying magnetic field and controlling the flow of fluids from the heated portion of the deposit to the delivery point until the temperature of the heated portion of the deposit has reached a selected value at which substantial pyrolysis occurs of hydrocarbons released from the deposit. The value of temperature resulting is less than the break-out pressure of the overburden. When the selected temperature and the pressure have been reached the flow of fluids from the heated portion of the deposit is controlled by a pressure controller to maintain the pressure until heating stops. At this time the vapor pressure is reduced to atmospheric pressure.

2 Claims, 1 Drawing Figure

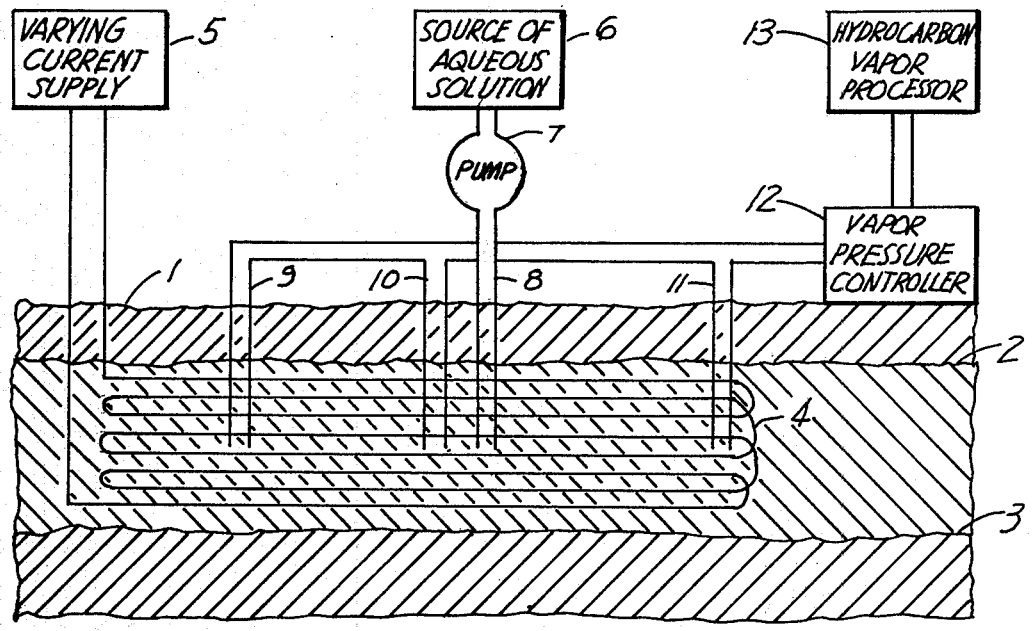
VARYING CURRENT SUPPLY
5
SOURCE OF AQUEOUS SOLUTION
6
13
HYDROCARBON VAPOR PROCESSOR
7
PUMP
12
VAPOR PRESSURE CONTROLLER
1
9
10
8
11
2
4
3

RECOVERY OF UNDERGROUND HYDROCARBONS

BACKGROUND OF THE INVENTION

This invention discloses a method of extracting hydrocarbons from an underground deposit, by heating the deposit underground by varying magnetic fields.

In the prior art methods are known for extracting hydrocarbons from an underground deposit by heating the deposit underground by varying magnetic fields. This invention depends on our discovery that substantial pyrolysis of most hydrocarbons takes place at temperatures materially below the temperature which may generate break-out pressure, and in our method underground fluid pressure is allowed to build up until substantial pyrolysis has occurred and is maintained at this selected value, below the break-out pressure, by pressure-controlled release of fluids to the delivery point.

BRIEF DESCRIPTION OF THE INVENTION

This invention discloses the method of extracting hydrocarbons from an underground deposit of materials containing hydrocarbons, the hydrocarbons extracted not necessarily being the same as the hydrocarbons contained in the deposit, by injecting an aqueous solution, containing a solute which gives it a relatively low resistivity compared to ground water, into at least a portion of the deposit of hydrocarbons, and underground heating of at least a portion of the hydrocarbon deposit, including that portion into which the aqueous solution has been injected, by means of a varying magnetic field. The aqueous solution and the hydrocarbons absorb heat from the magnetic field and expand, but the underground formation pressure prevents the water becoming steam. Fluids are prevented as far as possible from flowing from the deposit of hydrocarbons as the temperature rises, in order to prevent the formation of steam, until a selected temperature is reached at which temperature substantial pyrolysis of the hydrocarbons has taken place. For usual hydrocarbons the selected temperature is materially lower than the critical temperature of 374° C., which has a critical pressure of 3206 pounds per square inch. Thus liquid water and the solute remain in the hydrocarbon deposit during pyrolysis of a material portion of the heated hydrocarbons. As the temperature passes through 374° C. the water is converted to steam but by the time this temperature is reached the resistivity of the hydrocarbons has dropped to a value at which they are heated effectively by the fluctuating magnetic field, so that the temperature continues to rise.

The steam and hydrocarbon vapors are led to the surface and passed through a pressure controller, at substantially the selected pressure throughout the entire heating cycle, which is discontinued when a substantial flow of hydrocarbon vapor ceases. Steam mixed with the hydrocarbon vapors may be returned underground. At this point the pressure controller allows all hydrocarbon vapors in the underground system to be delivered to the surface at atmospheric pressure or less.

The hydrocarbon vapors may be processed at the surface to produce desired substances, heat in the vaporizable portion of the underground structure may be used to generate steam, and carbon remaining in the underground structure may be combusted with injected air and steam to produce energy in the form of gas of low calorific value.

BRIEF DESCRIPTION OF THE DRAWING

The drawing shows a schematic diagram of a system which operates according to the method of the invention.

DETAILED DESCRIPTION OF THE INVENTION

The drawing shows the surface of the ground, line 1, as the top of a layer of minerals, which forms the overburden of a deposit of material containing hydrocarbons, in depth from line 2 to line 3. Below line 3 the minerals may continue for some distance without further hydrocarbons.

A coil 4, of low-resistivity conductors, insulated and cooled as may be necessary, carries a varying current from varying current supply 5, and generates a varying magnetic field of highest intensity within the turns and close to the turns but outside them. The coil is shown in the drawing with horizontal circular turns, but the turns may be of any suitable closed shape, and may be at an angle to one or more of lines 1,2, and 3, which may not be parallel to one another. A source of aqueous solution 6 delivers aqueous solution through pump 7 and pipe 8 to one or more points within the portion of the hydrocarbon deposit subject to the varying magnetic field from coil 4. Fluid extraction pipes 9,10 and 11 extend from one or more points within the portion of the hydrocarbon deposit subject to the magnetic field of coil 4 and deliver fluid from the deposit to pressure controller 12.

Pressure controller 12 receives the fluid from the hydrocarbon deposit and retards flow of fluid until the pressure has risen to a selected value, corresponding to a temperature at which hydrocarbons in the hydrocarbon deposit are substantially pyrolized, but lower than the break-out value of fluids through the overburden. Pressure controller 12 continues to pass gas, vapors and steam delivered to it to hydrocarbon vapor processor 13 at a rate which substantially maintains the selected pressure at the input of controller 12. When the heating cycle is discontinued, pressure controller 12 allows fluid to pass to processor 13 at atmospheric pressure or lower. Controller 12 may be on the surface as shown or may be undergrond.

Hydrocarbon vapor processor 13 may separate and deliver separately non-condensable gases such as methane, steam which may be returned to source 6, and condensable hydrocarbon vapors which may be processed as desired.

The temperature and pressure may be controlled so that elemental sulfur in the deposit is not vaporized and passes off to the surface.

We claim:

1. The method of extracting hydrocarbons from an underground deposit of material containing hydrocarbons, which comprises:

injecting a conducting aqueous solution into a portion of said underground deposit, and generating a varying magnetic field, at least a portion of said magnetic field including at least a part of said portion of said underground deposit into which said conducting aqueous solution has been injected, and collecting said fluid injected and fluids generated by the heating effect of said magnetic field on said portion of said underground deposit, and delivering said collected fluids to the input of a pressure controller, which substantially retards the flow of said collected fluids until the pressure at said input has risen to a selected value, corresponding to a selected temperature at which substantial pyrolysis occurs underground of hydrocarbons released by said heating effect of said magnetic field on said deposit containing hydrocarbons, but which is below the break-out value of fluids through the overburden of said deposit containing hydrocarbons, which passes fluids at said input to an external device at a rate which maintains said selected pressure substantially constant at the input to said pressure controller, and which passes said collected fluids substantially freely when said varying magnetic field is discontinued.

2. The method according to claim 1 in which said generated heat and said flow of fluids is controlled to prevent the vaporization underground of elemental sulfur.

* * * * *